US005887815A

United States Patent [19]

Pierce

[11] Patent Number: 5,887,815

[45] Date of Patent: Mar. 30, 1999

[54] CABLE WINDING DEVICE FOR ELECTRICALLY POWERED MINING VEHICLES

[76] Inventor: Steve Pierce, 625 Saratoga Dr., Green River, Wyo. 82935

[21] Appl. No.: 963,418

[22] Filed: Nov. 3, 1997

[51] Int. Cl.[6] ..... B65H 75/40

[52] U.S. Cl. ..... 242/386; 191/12.2 A; 242/390.9; 242/397.3; 242/909

[58] Field of Search ..... 242/386, 390.6, 242/390.9, 390.8, 390.5, 397.3, 909; 191/12.2 A

[56] References Cited

U.S. PATENT DOCUMENTS

| | | | |
|---|---|---|---|
| Re. 34,488 | 12/1993 | Clark | 242/397.3 |
| 1,999,261 | 4/1935 | Shultz et al. | 191/12.2 A |
| 2,639,336 | 5/1953 | Woolf | 191/12.2 A |
| 2,941,746 | 6/1960 | Hunt | 242/386 |
| 3,061,233 | 10/1962 | Dudley | 242/397.3 |
| 3,386,682 | 6/1968 | Bajek | 242/397.3 |
| 4,211,376 | 7/1980 | Martin | 242/390.6 |
| 4,258,834 | 3/1981 | Hawley et al. | 191/12.2 R |
| 4,569,489 | 2/1986 | Frey et al. | 242/390.6 |
| 4,583,700 | 4/1986 | Tschurbanoff | 242/390.9 |
| 4,701,974 | 10/1987 | Konig et al. | 15/323 |
| 4,767,073 | 8/1988 | Malzacher | 242/397.3 |
| 5,402,959 | 4/1995 | Wadle | 242/386 |
| 5,419,508 | 5/1995 | Pierce | 242/386 |
| 5,485,972 | 1/1996 | Mummery et al. | 242/386 |

*Primary Examiner*—John M. Jillions
*Attorney, Agent, or Firm*—Dennis Mangrum

[57] ABSTRACT

An electrical cable management device for use in mining and other applications where there are size restrictions on equipment. The device is a round stationary drum, around which travels a carriage for winding, unwinding and storing hot electrical cable. The device is mounted on skids and is portable and can be located away from the mining activity while still being able to manage and control the winding and unwinding of electrical cable in response to movement of the mining equipment. The device does not require electrical split ring connectors, rotating collector rings, brushes or the like, but provides a continuous cable from a power source to the moveable mining equipment. The orbiting carriage is driven by an electric motor for winding cable and automatically becomes free wheeling when cable is unwound from the drum.

7 Claims, 3 Drawing Sheets

CABLE WINDING DEVICE FOR ELECTRICALLY POWERED MINING VEHICLES

BACKGROUND OF THE INVENTION

1. Field of the Invention

This invention relates to a device for the management of electrical cable used in mining operations to power moving mining equipment. The device winds and unwinds cable from a drum upon demand and keeps the cable out of harms way.

2. Description of the Prior Art

Almost all power utilized to operate equipment and machinery in mining operations is electrical. Mining operations require highly specialized equipment that either dump, haul, or bore tunnels into the rock or other earth strata as they move about in mining operation. These vehicles have to be moveable, and they have to have the capability of operating in confined, small locations, like mine tunnels. A typical vehicle would be a miner. A miner is a vehicle which bores into the rock, or other earth strata by the use of tools and other implements on the front of the vehicle. The rock ore that has been excavated at the front end, is conveyed to the rear of the vehicle, and dumped into other vehicles for hauling to other locations for removal to surface. These vehicles are powered by electricity from flexible cables that carry very high voltage. The fact that these vehicles are moveable requires that they be capable of being attached to an electrical cable so that they always have direct power sufficient for their operation. The handling of the cable is a major problem since the vehicles move about freely. The cable must always be handled so as to be kept clear of being run over by mining equipment and yet there must be sufficient cable available to permit travel and movement by the equipment. Typically, most mining vehicles that are electrically driven utilized manual labor, or workers, to manhandle, drag or reel the electrical cable as the machine or vehicle moves, about in the mine tunnels. Such work is dangerous, because of standing water, high voltage, and heavy cable, in addition to damage caused by mining vehicles.

There are, however, numerous known mechanical devices for spooling and/or handling electrical cables of mining vehicles as they move about in mining tunnels. All known devices have inherent defects or problems involved with their use.

The single most serious problem of known devices is the method for managing electrical cable which powers the vehicle. In most known devices, a rotating drum or reel is utilized to spool the cable. In all devices that utilize rotating drums to spool the cable, slip-rings, rotating collector rings, brushes or the like are employed to couple the power line coming and leaving the reel. Two of many examples are Dudley U.S. Pat. No. 3,061,233, and Tschurbanoff U.S. Pat. No. 4,583,700. Others employ the same technology. These slip rings and the like are potentially dangerous in mining operations. Mining regulations (see part 18.43 of 30 CFR ch 1 of Mine Safety and Administration) require that all such slip-rings and the like be contained within explosion proof boxes and even when that is done, those connectors are unreliable and severely wear prone, due to the severe environment conditions of a mine. They are also expensive, complicated, and ineffective. Additionally, the explosion proof enclosures are large and utilize excess amounts of space on the mining vehicle.

A more recent system for storing cables is described in U.S. Pat. No. 4,258,834, issued to Hawley. There, no slip-rings are employed. There, cable is dumped or pulled into or out of a large drum. The cable is fed through a round sleeve in which are disposed frictional devices which engage the cable and pull it into the drum. Hawley unlike the present invention not only can handle round cable, but flat, oblong, etc. The prior art devices make no allowance to handle other than round cable. Further the electrical cable used in Hawley is not continuous from the power source to the mining vehicle but uses slip rings or other dangerous connectors.

The device described in Hawley and other prior art patents describe a stationary drum onto which cable can be loaded by a rotating arm. The cable is supposed to stack systematically, simply by gravity and the weight of the cable. However the cable is pulled into the drum by friction type device which squeeze the cable and pull it through the feeding fair-lead. Once the cable is clamped and squeezed, it restricts twisting of the cable, so when the cable is dumped into the container, it will twist, wrinkle, and not stack in any uniform manner. Such stacking decreases the available space for storage of the cable in the drum, unlike the present invention where the cable is systematically loaded. Space in mining operations is very limited and must be kept to a minimum. Drum stacking cannot be used in mining operations. There is no method presently available to automatically manage power cables for mining operation.

Almost all mining vehicles utilize the rear of the vehicle for mining operations. In Hawley, the container and storage bin is directly behind the vehicle while the drum of the present invention is disposed away from the mining operation and vehicle. A rear stacking device can not be used in most mining vehicle applications, simply because the drum must be located in a space used for work in a mining operation. The miner, for instance, cuts rock from the front and conveyors it to the rear for dumping and hauling. In operation it is also desirable that the power cable be placed on the side of the tunnel. If the cable is positioned or unwound and placed into the middle of the tunnel it interferes with all vehicles that may be moving in or about the tunnel. The present invention permits cable to be laid out at the side of the tunnel.

Lastly, all cables have splices and most are irregular shape. The prior art devices does not provide for the various size or shaped cables while the instant invention can operate with any shape of cable or splice.

There are devices like Dudley, supra, that utilize side mounted rotating reels. However, there is no known device which use a stationary reel for the storage and unwinding and winding of electrical cables, which can be disposed away from the mining operation while permitting the mining equipment to move freely about at will. The device automatically winds or unwinds cable in response to movement and/or demand of the mining equipment.

The other significant prior art is the applicant's own U.S. Pat. No. 5,419,508. That patent has as its salient feature an oblong stationary drum that is mounted on the side of a mining vehicle. That device does use a continuous power cable and orbiting device for winding cable on the fixed drum. The device also contemplates a clutch and pneumatic control system for winding and unwinding as provided in the present invention.

The instant invention contemplates a large cable management device. It can not be disposed on mining equipment and does not utilize an oblong drum. The present device can store large quantities of large cable and need not be disposed near the actual mining operation, where the cable can be damaged and cause serious injury or destruction. The device of the present invention weighs over 5,000 lbs. and is 78 inches in height, and can not be mounted on a mining vehicle, which is a critical element of patent 5,419,508. It is instead mounted on skids.

The stationary drum must be cylindrical in the present invention and cannot be oblong as described in the prior patent. This construction will permit the storage and management of large diameter electrical cable which the prior patent cannot handle.

These and other problems of the prior art devices are resolved by the present invention, which is described hereinafter.

SUMMARY OF THE INVENTION

A device for managing of large electrical cable is formed from a stationary cylindrical drum around which electrical cable can be wound or unwound by a revolving fairlead as cable is demanded by a tension sensing system. The electrical cable is continuous from the power service to the using device without the use of slip rings, etc. The revolving fairlead is electrically driven so as to apply a predetermined tension during winding and to release the fairlead to free wheel for unwinding of the cable. The fairlead when engaged is chain driven by electric power around the drum. The device is mounted on skids and can be located away from the actual mining operation so as not to be damaged.

It is an object of the present invention to eliminate any electrical connectors, i.e., slip rings, rotating connector rings, brushes, or the like, between the power source and the mining vehicle, by utilizing a stationary reel.

It is an object of the present invention to wind and unwind cable under a constant and predetermined pressure to maximize cable storage and prevent kinks, bends, and whipping of the cable.

It is an object of the invention to provide a device that is electrically or hydraulically operated to improve mine safety in the handling of electrical cables.

It is an object of the present invention to be able to dispose the mechanical systems of the invention inside of the drum to further protect them from damage.

It is an object of the present invention to air cool the electrical cable while wound on the drum by pressurizing and perforating the drum such that air will circulate around the cable.

It is an object of the present invention to enable cable to be wound or unwound on the drum without deformation.

It is an object of the present invention to provide a device that is fully portable and mounted on skids so as to be moved and utilized in mining operation where there is limited work space or in any other location where management of electrical cable is required.

DETAILED DESCRIPTION OF THE PREFERRED EMBODIMENT

Figure 1:
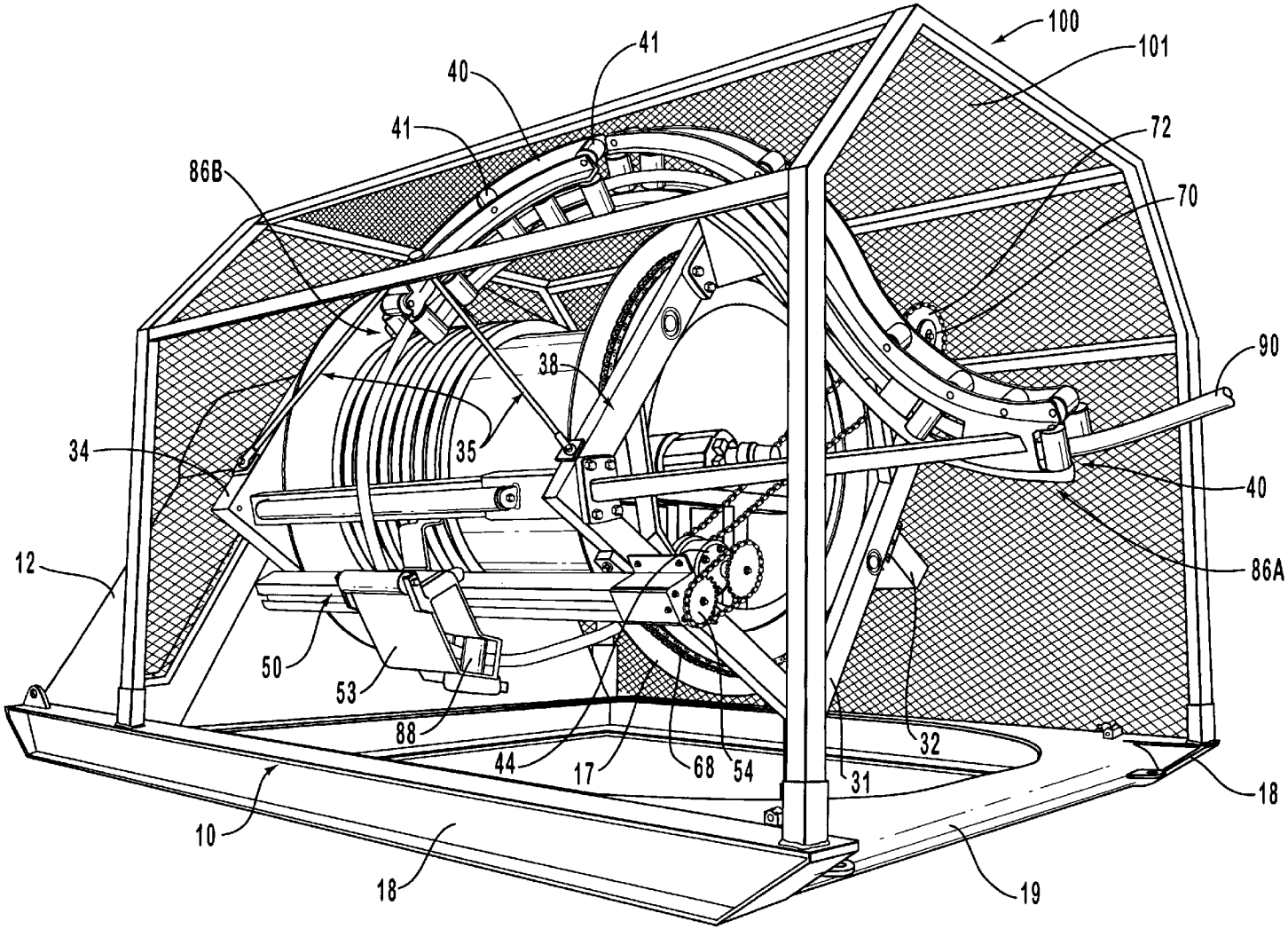

The preferred form of the present invention will now be described. It is understood that there can be various changes to the preferred form of the present invention without detracting from the spirit or the scope of the invention.

The invention is primarily formed from a high grade industrial steel. It is comprised of three main components: a main frame 10, part of which is a drum 15 on which cable 90 is stored; a carriage 30 which rotates around the drum 15 winds or unwinds cable 90 from the drum 15; and a cable guide fairlead 40 which is affixed to the carriage 30 through which the cable 90 is picked up and positioned for winding or unwinding. Each of these components will be described separately and then their function and relationship to the other components will be described hereinafter.

The main frame 10 is comprised of a supporting base of skids 18, a rear housing 12 and the cable drum 15. The skids 18 support the entire device and permit it to be moved on the skids. The frame is formed of substantial steel members comprising the outside dragging skids 18 and cross members 19. These members are generally welded. The rear housing 12 is formed from heavy metal plate and is formed as an integral part of the drum 15. The drum 15 protrudes from the rear housing 12 towards the front of the skids 18, so as to cantilever from the rear housing 12. The inner storage portion of drum 15 is defined by a front flange 17 and a rear flange 16. The inside of the drum as well as the rear housing is hollow and serves to house the mechanical elements of the invention as described hereinafter. On the front side of the front flange 17 is disposed the front drive sprocket 68 and on the outside of rear flange 16 is disposed the rear drive sprocket 69. Both sprockets 68 and 69 are solidly affixed to front and rear flanges 16 and 17 respectively. (They do not turn). On the outside of each flange is disposed a track 84 and 85 in which the cam follower bearings 80 of the carriage 30 travel, as described hereinafter.

Figure 2:
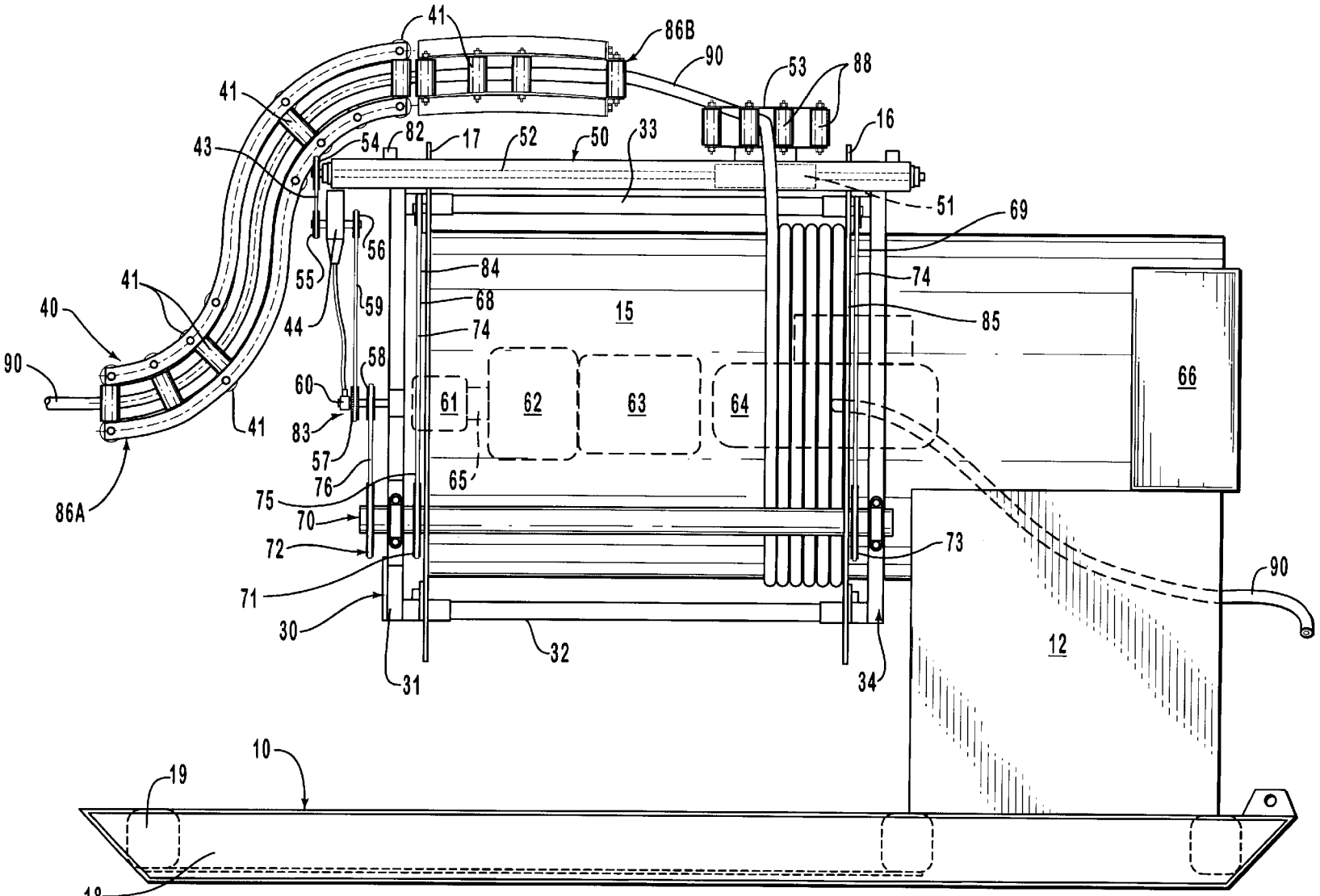
Figure 3:
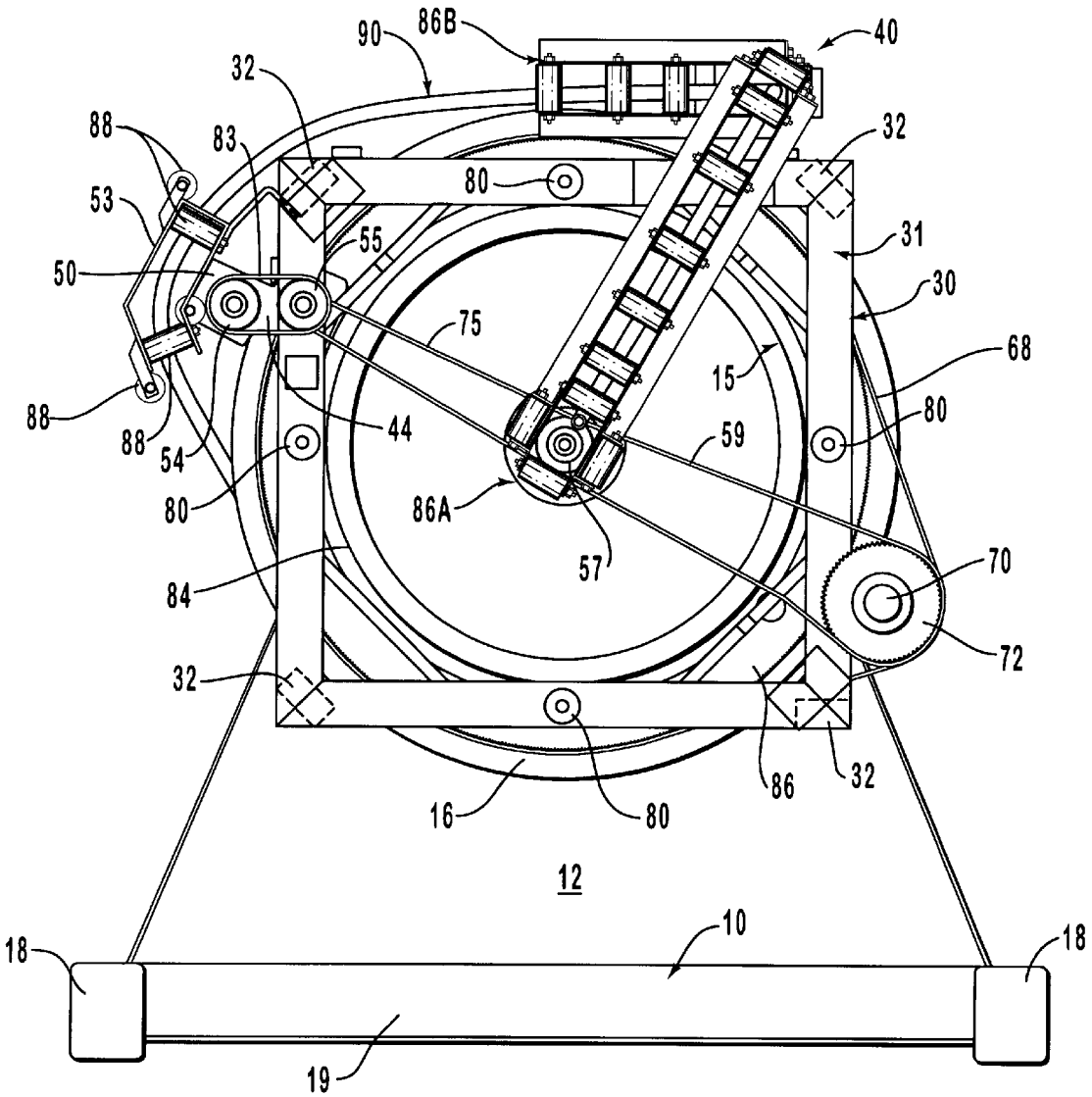

The carriage 30 has a front square frame 31 and a rear square frame 34. The carriage frames 31 and 34 are formed of heavy steel members and welded at the comers. The carriage frames 31 and 34 have cam follower bearings 80 disposed at the mid point of each side of each frame and also at the comers where they engage the front 84 and rear 85 of the cam follower track 84 and 85. Four carriage cross members 32 connect the front 31 and rear 34 carriage frames and make the carriage 30 an integral rigid member. The cross frame members 32 are typically welded to the front 31 and rear 34 frames. A level wind tube 50 is also welded to the front and rear carriage frame as shown in FIG. 1 and 2. The construction and operation of the level wind tube 50 are described hereinafter. The carriage 30 is disposed around the drum 15 and rotates freely there around on the cam followers bearings 80 as they engage the cam follower tracks 84 and 85.

A guide fairlead 40 is coupled to the front carriage frame 31 such that it has a front end that projects forward of the front carriage frame 31. The fairlead tube 40 serves to collect the cable 90 so as to pass through and be spooled or unspooled on drum 15 when the carriage 30 rotates as hereinafter described. The guide fairlead 40 is formed from "rolled or radiused" angle iron and has multiple rollers 41 spaced throughout its length on which the cable 90 passes without impingement. The guide fairlead 40 has it's lead end 86A disposed at the forward of and at the center line of the drum 15. The guide fairlead 40 transforms gradually so as to extend outside of the entire drum 15, and then curves gently so as to parallel the axis of the storage drum. The fairlead 40 then curves gently at a right angle and is terminated at the rear end 86B which is located so as to be in parallel alignment with the front flange 17. Cable 90 which passes through the guide fairlead 40 enters at the front end 86A of the fairlead 40 and makes several bends until it exits the fairlead 90 degrees from its entry position 86A and can be picked up from the drum as it is unwound or wound on the drum 15. End 86B of the guide fairlead 40 is in the preferred form secured in place by two steel cross members 35 that are attached to the front and rear of the carriage frame 30.

The level wind tube 50 is disposed so that cable 90 exiting the guide fairlead 40 passes through the level wind rollers 88. The rollers 88 are secured to the indexing fairlead frame 53. As the carriage 30 rotates, the indexing fairlead causes rollers 88 to move along the level wind tube 50 as the ball screw 52 inside the level wind tube turns, thus driving sliding follower 51. In this manner cable 90 will be wound uniformly on drum 15. Sprocket 54 is mounted to the ball screw of the level wind tube 50. Sprockets 54 and 55 are joined by chain 43. Sprockets 55 and 56 are on the same axis with a reversing planetary transmission 44 between them which selects and provides the left and right and direction of travel to the indexing fairlead 53 as needed.

A carriage drive shaft 70 is mounted on the carriage frame so as to be on the opposite side as the level wind tube 50. A power sprocket 72 is mounted near the front end of the drive shaft 70 and drive sprockets 71 and 73 are mounted near the front and rear ends. The drive sprockets are disposed so as to be in alignment with the sprockets 68 and 69 respectively. A chain 74 is disposed around the rear carriage drive sprocket 71 and a similar chain around the front drum sprocket 68. This system of sprockets and chains are used to uniformly drive the carriage 30 around the drum 15 as is described hereinafter.

The mechanical equipment that is used to drive the present invention is housed within the drum 15. In this manner the equipment is protected from the environment and other damage. The mechanical equipment comprises an air operated main drive clutch 61, a gear reducer 62, an electric motor 63 and an air rotor seal 65. Also an air compressor 64 and control box 66 are located inside the drum 15. The electric motor 63 is coupled to the power shaft 60 through the gear reducer 62 and the main clutch drive 61. The power shaft extends from the front of the drum 15 and has two drive sprockets 57 and 58 coupled thereto. Drive sprocket 57 is aligned with the drive sprocket 56 that is mounted on the level wind sprocket and has a chain 59 that encircles the two drive sprockets. Drive sprocket 58 is aligned with the carriage power sprocket 72 and has chain 76 that engages sprocket 58 and the drive sprocket 72.

The operation and interaction of the various elements of the invention will now be described. Initially the power cable 90 is threaded through the guide fairlead and wrapped around the drum 15 and exits towards the rear of the invention and connected to a power source. The other end, the lead end is coupled to the working unit. When the working unit, a miner for example, reverses it's direction of travel there is excess cable 90. The invention senses the reduction in tension on the cable 90 and the electric motor begins to turn shaft 60. Shaft 60 simultaneously begins turning drive sprockets 57 and 58. Chain 76 turns sprocket 72, thereby turning sprocket 71 and 73 which forces the entire carriage 30 to begin to rotate clockwise around the drum 15 and wind cable 90 onto the drum 15. At the same time sprocket 57 engages chain 59 and drives, sprocket 56, which in turn activates reversing transmission 44. Cable 90 is properly layered by changing rotation of sprocket 55 which automatically activates the pneumatic controls of reversing transmission 44 and drives sprocket 54 which in turn causes ball screw 52 and indexing guide 53 to move along the drum so as to cause the cable 90 to be uniformly wound on the drum 15.

When the working unit starts moving forward and demands additional cable 90 the drive clutch 61 senses the increase in tension in the cable 90 and releases carriage 30 so that it is essentially free wheeling which allows cable 90 to be withdrawn from the drum 15, under controlled conditions.

Since the drum 15 does not rotate, one end of the cable 90 can be coupled directly to the primary power source. The cable 90 can then be partially spooled on the drum 15 exit the invention through the guide fairlead 40 and be coupled directly to the working unit. In this manner the power cable 90 is uninterrupted and there is no need for use of split rings and/or the like. The invention is portable and is capable of being moved from place to place, but can be located away from the actual work area and be out of harms-way, while still being able to manage the demand for the cable so that the working unit can move about and the cable 90 will be wound or unwound as required.

In the preferred form drum 15 is perforated with randomly placed holes through which air can flow. The inside of the drum 15 is enclosed so that air can be released into the drum through the air seal 65 which allows air to be forced out of the perforations and around the cable 90 disposed on the drum. The air cools the cable 90 which can heat and can cause cable damage if not properly cooled.

In the preferred form of the invention a steel frame 100 is constructed around the invention and a heavy steel mesh 101 is attached to the frame. This frame and mesh prevent and protect the invention from getting hit by falling rocks or other debris in work areas.

It is understood that the mechanical system as described herein that drive the carriage around the drum can be altered or parts thereof can be substituted to perform the same function and not detract from the spirit and scope of the invention.

I claim:

1. A device for use in management of large live electrical cable and the like, said electrical cable for supplying electrical power directly from a power source to moving equipment, said device being moveable during operation comprising;

a cylindrical non-rotating drum on which said electrical cable can be controllably and automatically wound or unwound in response to movement of said equipment;

a revolving carriage for rotating about said cylindrical drum thereby winding or unwinding said electrical cable from said drum;

a means for sensing movement of said equipment and for controllably directing the rotation of said revolving carriage to wind or unwind cable;

whereby said device automatically manages the winding and unwinding of said electrical cable in response to movement of said equipment, said device being positionally locatable to any position along said electrical cable to manage said electrical cable, at any time without interrupting the flow of electrical current in said cable from said power source to said equipment while reducing stress on said electrical cable, yet keeping said device far from said equipment.

2. The device of claim 1 wherein said non-rotating drum is perforated and internally pressurized for forcing air out from said drum and around said electrical cable wound thereon for cooling said electrical cable.

3. The device of claim 1, wherein the entire inside of said non-rotating drum is utilized to contain the mechanical elements necessary to operate said device.

4. The device of claim 1 wherein said revolving carriage rotates around said cylindrical drum and unwind said electrical cable, said revolving carriage coupled to a level wind mechanism comprised of a lead indexing screw with one-way threads having an indexing fairlead engaging said indexing screw, said level winding mechanism coupled to said means for sensing movement of said equipment and managing the direction of rotation of said indexing screw, said sensing means comprising at least a reversible planetary transmission controllably driven by a pnuematic system which senses stress on said cable caused by movement of said equipment and automatically drives said revolving carriage to wind or unwind said cable.

5. The device of claim 4 wherein a revolving carriage comprised of fairleads, cable guides and rollers combine to provide a smooth transitional path for said electrical cable as it is wound or unwound from said drum, said transitional path having a bending radius not exceeding cable manufacturers recommendations.

6. The device of claim 1, wherein said stationary drum is sized for use in underground mining applications.

7. The device of claim 5 wherein said revolving carriage is rotatably supported by roller bearings that glide in a track disposed around said drum, and support said revolving carriage.

* * * * *